US005518491A

United States Patent [19]

Romer et al.

[11] Patent Number: 5,518,491

[45] Date of Patent: May 21, 1996

[54] ENVELOPE MAKER AND A METHOD OF USING

[76] Inventors: Nicholas K. Romer, 1002 Markham Ct. Unit E, Belair, Md. 21014; Christine L. Waydick, 333 Valley View Dr., Waynesboro, Pa. 17268

[21] Appl. No.: 339,885

[22] Filed: Nov. 14, 1994

[51] Int. Cl.[6] ..... B31B 47/02; B31B 49/04

[52] U.S. Cl. ..... 493/231; 493/252; 493/468

[58] Field of Search ..... 493/231, 243, 493/245, 250, 251, 252, 253, 405, 453, 468

[56] References Cited

U.S. PATENT DOCUMENTS

| | | | |
|---|---|---|---|
| 13,647 | 10/1855 | Goodales | 493/231 |
| 14,643 | 4/1856 | Low | 493/231 |
| 64,537 | 5/1867 | Jaeger | 493/253 |
| 138,028 | 4/1873 | Keating | 493/250 |
| 207,288 | 8/1878 | Laverty | 493/916 |
| 453,436 | 6/1891 | Bouvier | 493/250 |
| 659,960 | 10/1900 | Ermold | 493/917 |
| 980,539 | 1/1911 | Lester | 493/917 |
| 1,941,412 | 12/1933 | Nicholas | 493/917 |
| 2,718,828 | 9/1955 | Buda et al. | 493/917 |

*Primary Examiner*—Jack W. Lavinder
*Attorney, Agent, or Firm*—Joseph H. McGlynn

[57] ABSTRACT

An envelope maker made of two pieces, a template which is used as a guide to dimension paper to the correct size and having a central cut out portion to position a second piece, called the center piece, with respect to the paper. The center piece is left on the paper while the template is removed. The center piece is then used as a guide to fold the paper into an envelope, and adhesive is applied to secure the folded parts of the paper in an envelope shape.

2 Claims, 1 Drawing Sheet

ENVELOPE MAKER AND A METHOD OF USING

BACKGROUND OF THE INVENTION

This invention relates in general to apparatus for making envelopes and a method of using the apparatus.

DESCRIPTION OF THE PRIOR ART

In the prior art, envelopes have been made using various types of apparatus, however, the apparatus have all been either the type used to make many envelopes at one time, or complicated and time consuming apparatus to make envelopes one at a time.

SUMMARY OF THE INVENTION

This invention relates to a simple apparatus for making one envelope at a time. It consists of two pieces: a template and a center piece. The template is used to determine the correct size of the material used to make an envelope. It has a central cut out portion to correctly position the center piece which is used as a guide to fold the material into an envelope.

The two pieces are economical to produce and simple enough to use that even a child can easily produce perfect envelopes every time.

It is an object of this invention to produce a simple to use envelope maker that can be used by anyone to make perfect envelopes every time.

It is an object of this invention to produce an envelope maker that is inexpensive to produce.

It is an object of this invention to produce an envelope maker that can be used to make an envelope from virtually any type of material.

It is an object of this invention to produce an envelope maker that can use recyclable material as the raw material in producing envelopes.

These and other objects and advantages of the present invention will be fully apparent from the following description, when taken in connection with the annexed drawings.

DESCRIPTION OF THE PREFERRED EMBODIMENT

Figure 1:
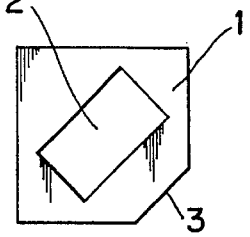
FIG. 1 shows a plan view of the envelope template.
Figure 2:
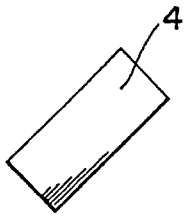
FIG. 2 shows a plan view of the center piece.

FIG. 1 shows one of the two pieces that make up the envelope maker of the present invention, the template 1. FIG. 2, shows the second piece that makes up the envelope maker, the center piece 4. It should be noted that template 1 is approximately 8 inches by 8 inches, and the center piece is approximately 6 inches by 4 inches, and each of the pieces is 1/16 inch thick. However, these dimensions are not critical to the invention as long as the pieces are thin enough to allow paper to be folded around the edge. The dimensions can be varied to make different sizes of envelopes.

Figure 7:
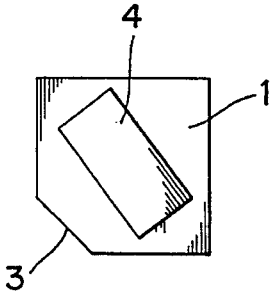

The template 1 is essentially square with one corner removed as at 3. It, and the center piece 4, can be made of any thin, relatively rigid material, but plastic is preferred, and can be either clear or a colored plastic. The material has to be strong enough so it will not bend during the making of an envelope, but at the same time thin enough so paper can be folded around it. The template 1 has a rectangular cutout 2 which is at an angle to the vertical axis of the template 1, as shown in FIG. 1. The cutout 2 is slightly larger than the center piece 4, and will receive the center piece 4, as shown in FIG. 7.

Figure 4:
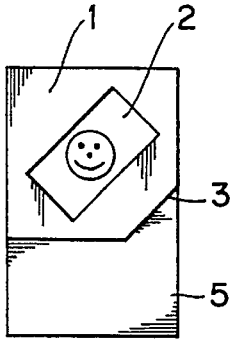
FIGS. 4–13 show the sequential steps necessary in using the envelope maker to produce an envelope.

The cutout 2, shown in FIG. 4, is used to "frame" a picture that can be used on the envelope, as will become apparent below when the use of the template 1 and the center piece 4 are explained.

Figure 3:
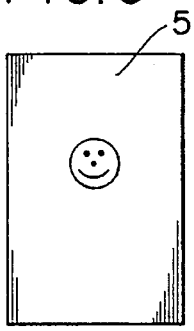
FIG. 3 shows a plan view of a sheet of paper from which an envelope will be made.

How the template 1 and the center piece 4 are used is shown in FIGS. 4–13, and will now be described. The first step is to select a piece of paper 5 (it can be a page from a magazine or virtually any other kind of paper). The size of the paper is not critical, as long as it is larger than the template 1. The paper selected in FIG. 3 has a smiling face, which can be used as a decoration on the envelope. However, the smiling face is used in the drawings primarily to show the front side of the paper, and what will eventually become the outside (front) of the envelope. The next step, as shown in FIG. 4, is to place the envelope template 1 on top of the paper with the cutout 2 framing the desired picture, in this case a smiling face, that will appear on the outside (front) of the envelope.

Figure 5:
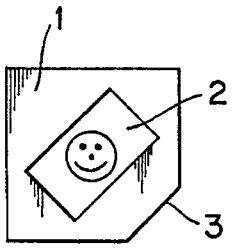
Figure 6:
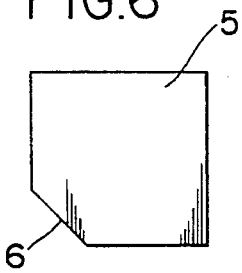

Next, the excess paper (whatever is larger than the template 1) is trimmed off or folded so the size of the paper is the same size as the template 1, see FIG. 5, and the paper is the same shape as the template 1, i.e. square with one corner removed as at 6 in FIG. 6. In this step, the edge of the template 1 can be used as a straight edge and the excess paper can be ripped off using the edge of the template as a guide.

Figure 8:
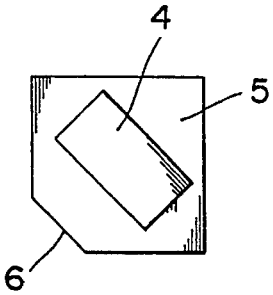
Figure 9:
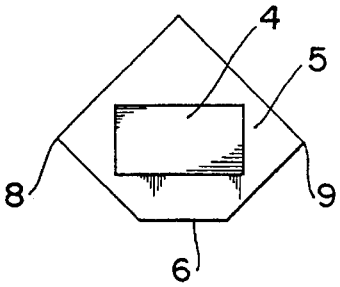
Figure 10:
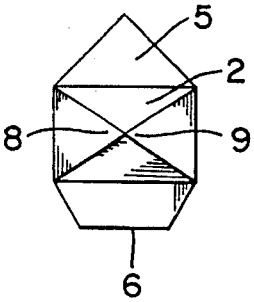
Figure 11:
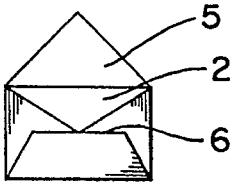

The next step is to turn the paper over so the part that will become the inside of the envelope is facing up, as in FIG. 6. Next, the template 1 is placed on top of the paper so as to match the paper and the template. The center piece 4 is placed inside the template 1, with the center piece positioned at an angle, as shown in FIG. 7. Now the template 1 is carefully removed leaving the center piece 4 in position on the paper as shown in FIG. 8. The paper is rotated in the direction of the arrow A, as seen in FIG. 8. FIG. 9 shows the final position of the paper with the cut off corner 6 at the bottom. With the cut off corner in this position the envelope will be easier to fold. The next step is shown in FIG. 10 where the left and right corners 8 and 9, respectively, are folded, using the sides of the center piece 4 as a guide, on top of the center piece 4. Next the cut off corner 6 is folded up on top of the left and right corners 8 and 9, respectively, as shown in FIG. 11. The next step is to fold the top flap down unto the center piece 4. Once this is done the center piece 4 can be removed.

Figure 12:
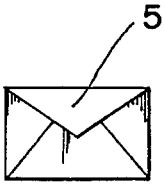
Figure 13:
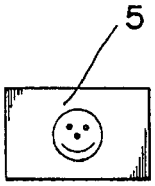

Now the envelope is essentially completed, except for applying glue or some other adhesive to hold the left and right corners 8 and 9, and the cut off corner 6 together. Glue will also be used to secure the top flap if the envelope will be sealed, as shown in FIG. 12. FIG. 13 shows the front of the completed envelope.

Although the envelope maker and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An envelope maker for making an envelope from paper consisting of two pieces, a first piece formed in the shape of a square with one of the corners removed to form five side edges and five corners, a second piece shaped as a rectangle, said five side edges of said first piece providing means for determining the exact size of paper necessary to form an envelope, said first piece having a portion removed from the interior of said first piece, forming a rectangular cutout slightly larger than the outer dimensions of said second piece, said cutout providing means for positioning said second piece, and said second piece being means to guide folding of said paper into an envelope.

2. A method of making an envelope comprising, selecting a material from which said envelope will be made, said material having a vertical axis, placing a first piece having five side edges and five corners and a cut out center portion on top of said material, removing or folding all portions of said material that extend beyond the edges of said first piece, placing a rectangular second piece into said cut out center portion in said first piece with the longitudinal axis of said second piece at an angle to the vertical axis of said material, removing said first piece and leaving said second piece on said material, then folding said material using said second piece as a guide to form an envelope.

* * * * *